US009319801B2

(12) United States Patent
Gottschalk et al.

(10) Patent No.: US 9,319,801 B2
(45) Date of Patent: Apr. 19, 2016

(54) AUTOMATIC IDENTIFICATION OF RECEIVER TYPE IN HEARING AID DEVICES

(75) Inventors: Georg Gottschalk, Erlangen (DE); Frank Wagner, Hemhofen (DE)

(73) Assignee: Sivantos GmbH, Erlangen (DE)

( * ) Notice: Subject to any disclaimer, the term of this patent is extended or adjusted under 35 U.S.C. 154(b) by 2333 days.

(21) Appl. No.: 12/229,327

(22) Filed: Aug. 21, 2008

(65) Prior Publication Data

US 2009/0052706 A1 Feb. 26, 2009

(30) Foreign Application Priority Data

Aug. 21, 2007 (DE) ..... 10 2007 039 452

(51) Int. Cl.
*H04R 25/00* (2006.01)

(52) U.S. Cl.
CPC ..... *H04R 25/305* (2013.01); *H04R 25/556* (2013.01); *H04R 25/604* (2013.01); *H04R 25/70* (2013.01); *H04R 2420/05* (2013.01)

(58) Field of Classification Search
CPC ..... H04R 2420/05; H04R 25/305; H04R 25/556; H04R 25/604; H04R 25/70
USPC ..... 381/23.1, 312–314
See application file for complete search history.

(56) References Cited

U.S. PATENT DOCUMENTS 3,457,375 A * 7/1969 Haggerty ..... H04R 25/456 381/322
4,379,401 A * 4/1983 San Miguel ..... G01N 33/227 73/12.08
4,520,236 A * 5/1985 Gauthier ..... H04R 25/456 381/323
6,556,686 B1 * 4/2003 Weidner ..... H04R 25/556 381/312
6,895,345 B2 * 5/2005 Bye ..... A61B 5/121 381/23.1
2002/0044669 A1 * 4/2002 Meyer ..... H04R 25/558 381/314
2003/0086582 A1 5/2003 Vonlanthen
2005/0008175 A1 * 1/2005 Hagen ..... H04R 25/70 381/314
2006/0159298 A1 * 7/2006 von Dombrowski .. H04R 25/48 381/330
2008/0279409 A1 * 11/2008 Hupkes ..... H04R 1/1066 381/370
2008/0317266 A1 * 12/2008 Youn ..... H04R 17/005 381/190

FOREIGN PATENT DOCUMENTS

| | | | |
|---|---|---|---|
| CH | 673366 | A5 | 2/1990 |
| EP | 0480097 | A1 | 4/1992 |
| WO | WO 9909799 | A2 | 3/1999 |
| WO | WO 2007045254 | A1 | 4/2007 |

* cited by examiner

*Primary Examiner* — Mohammed Shamsuzzaman

(74) *Attorney, Agent, or Firm* — Laurence A. Greenberg; Werner H. Stemer; Ralph E. Locher

(57) ABSTRACT

In a hearing aid system, which comprises at least one hearing aid device, incorrect adaptation of the signal processing unit of the hearing aid device to the receiver used is intended to be avoided. To this end, automatic identification of the type of receiver used is proposed, as well as automatic adaptation of the signal processing in the hearing aid device by the hearing aid system. Incorrect manual adaptation is thereby prevented.

7 Claims, 3 Drawing Sheets

FIG 3
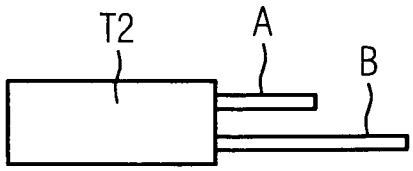
FIG 4
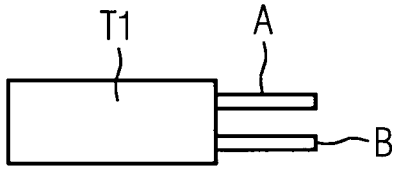
FIG 5
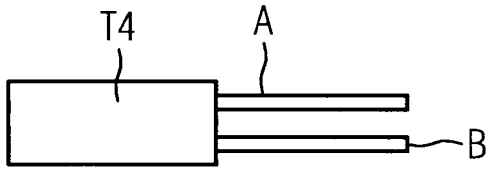
FIG 6
| SA | SB | TYP |
|---|---|---|
| open | open | T1 |
| open | close | T2 |
| close | open | T3 |
| close | close | T4 |

AUTOMATIC IDENTIFICATION OF RECEIVER TYPE IN HEARING AID DEVICES

CROSS REFERENCE TO RELATED APPLICATIONS

This application claims priority of German application No. 10 2007 039 452.9 DE filed Aug. 21, 2007, which is incorporated by reference herein in its entirety.

FIELD OF INVENTION

The invention relates to a hearing aid system comprising at least one hearing aid device having an input transducer for receiving an input signal and converting said signal into an electrical input signal, a signal processing unit for processing and amplifying the electrical input signal and emitting an electrical output signal and a receiver for converting the electrical output signal into an acoustic output signal.

BACKGROUND OF INVENTION

Hearing aid devices are provided in different power classes. These are differentiated, in particular, by the respective type of receiver used, on which the maximum power output and the maximum sound pressure level able to be produced depend. In hearing aid devices which may be worn behind the ear, in which the receiver, when the hearing aid device is worn, is located in an earpiece in the ear canal of the user, so-called RIC-BTE (Receiver-in-Canal-behind-the-Ear) hearing aids, hearing aids of varying performance may be produced in a simple manner by the use of different earpieces with different receivers.

SUMMARY OF INVENTION

Generally the earpiece is releasably connected to the hearing aid housing by means of a plug connection, so that a replacement may be carried out, for example, by the acoustician. In this connection, it is important that the signal processing unit of the relevant hearing aid device is also adapted to the receiver used. If the amplification of an acoustic input signal by the hearing aid device is not adapted to the receiver used, it may possibly occur that the threshold of discomfort of the user may be exceeded, or even hearing damage may occur. Thus there is a desire for automatic adaptation of the signal processing and, in particular, the amplification of the signal to the receiver used.

A hearing aid comprising control elements for altering the signal transmission properties of the hearing aid is disclosed in CH 673 366 A5. The known hearing aid may be provided with a variable number of control elements and different control element functions may be associated with a control element. The control elements comprise control element contacts which are soldered to a printed circuit board of the hearing aid. For hearing aids with different control functions, the control elements may be covered by different covers, which comprise contact elements in different coded forms. In particular, different control functions are associated with different control elements by the number of contact reeds of the contact elements associated with the respective control elements.

It is the object of the present invention to prevent incorrect adaptation of the signal processing unit of a hearing aid device to the receiver used.

This object is achieved by a hearing aid device with the features according to the independent claims.

The fundamental idea of the invention is to provide means, by which the respective type of receiver used in the hearing aid device may be automatically identified.

The invention offers the advantage that, by the automatic identification of the respective type of receiver, the likelihood of incorrect adaptation is minimized. The relevant type of receiver is automatically identified and also the adaptation to the identified type of receiver is preferably carried out automatically. Incorrect adaptation of the signal processing unit to the respective type of receiver used is substantially eliminated as a result.

Various information carriers are considered for differentiating between different types of receiver, which carry information which may be detected automatically by the hearing aid system and which is characteristic for the respective type of receiver. To this end, one embodiment provides an electrotechnical component associated with the receiver, having an electrical property which is dependent on the respective type of receiver, the hearing aid device having means for detecting the electrical property, on the basis of which the type of receiver used may be derived. The electrotechnical component may be an electrotechnical component otherwise present in a receiver, for example the receiver coil. This has a characteristic impedance for the respective type of receiver, which may be automatically detected by means of impedance measuring carried out by the hearing aid system. The type of receiver used may, in turn, be derived from the measured impedance. Measuring the impedance by means of the hearing aid system is, however, relatively complicated. It is simpler to associate additional electrotechnical components with the receivers, which are purely used to differentiate between different types of receiver. For example, a resistor with a characteristic value for the respective type of receiver may be arranged in or on the housing of each receiver, the value thereof being able to be detected by the hearing aid system. If, for example, "Type 1", "Type 2" and "Type 3" receivers are to be differentiated, these may be associated with different resistors, for example 10 kOhm, 100 kOhm, 1 MOhm, so that by detecting the value of the resistor a clear identification of the respective type is possible. The measurement of the resistor and the automatic identification of the type of receiver associated therewith, are possible by relatively simple means. Naturally, however, other electrotechnical components and the electrical properties thereof (inductance, capacitance, electrical connection of a plurality of contacts, etc.) are also possible as information carriers.

A further embodiment provides mechanical means, with the aid of which different types of receiver may be automatically identified by a hearing aid system according to the invention. For example, in this connection, housing projections or recesses are considered, by means of which information is provided which is characteristic for the type of receiver used and which may be automatically detected by the hearing aid system.

A possibility to be implemented particularly easily by using mechanical means as information carriers consists in a specific embodiment of the connector pins present on a receiver used, and in particular in the use of connector pins of different lengths. Different lengths of connector pins may be detected in a simple manner and the different types of receiver derived therefrom.

In a particularly advantageous embodiment of the invention, the hearing aid device itself has the required means for automatic identification of the type of receiver used. It is, however, also possible that the hearing aid system according to the invention, in addition to the at least one hearing aid device, comprises a programming device for programming and/or adapting the relevant hearing aid device and the means for automatic detection of the type of receiver used are at least partially transferred into the programming device. It is thus possible, for example, that the hearing aid device merely has electrical contacts and cables, which permit a connection of a resistor associated with the receiver used to the programming device, the detection of the value of the resistor and the automatic identification of the type of receiver associated therewith, however, being carried out in the programming device. It is also possible that the hearing aid device has means for detecting information which is characteristic of the respective receiver, only data relative to this information, however, being stored in the hearing aid device, which may be read out from the hearing aid, and the evaluation of this data being carried out outside the hearing aid, for example, in the programming device.

In a similar manner to the automatic identification of the type of receiver used, the automatic adaptation of the signal processing unit of the hearing aid device to the identified type of receiver is also preferably carried out automatically by means of the hearing aid device. As a result, it is ensured that the signal processing unit of the hearing aid device, even after changing the receiver used, is always correctly adapted to the respective type of receiver.

In addition to the automatic adaptation of the signal processing to the receiver used by the hearing aid device itself, information about the type of receiver used may also be evaluated in a programming device associated with the relevant hearing aid device and, if required, displayed. Appropriate adjustments may then be manually undertaken by the operator of the programming device. Advantageously, however, the signal processing unit of the hearing aid device is automatically adapted by the programming device to the receiver used. Incorrect settings are thus also substantially avoided during operation of the adaptation device.

The invention may be used particularly advantageously with a hearing aid device which may be worn behind the ear, in which the receiver is located in an earpiece which may be worn in the ear (RIC-BTE). As, in these hearing aid devices, the earpiece together with the receiver generally is releasably connected to the housing of the hearing aid device which may be worn behind the ear, the receiver may be particularly easily replaced. However, the risk also increases that the signal processing in a relevant hearing aid device is not correctly adapted to the receiver used. Automatic identification of the type of receiver used, as well as automatic adaptation of the signal processing unit according to the invention, counteract this risk.

The invention may be used, moreover, particularly advantageously in all hearing aids of modular construction, in which a hearing module may be releasably connected to the hearing aid device. In this connection, the hearing aid device may be both a hearing aid device which may be worn in the ear (ITE) and a hearing aid device which may be worn behind the ear (BTE).

BRIEF DESCRIPTION OF THE DRAWINGS

The invention is explained in more detail hereinafter with reference to exemplary embodiments, in which:

FIGS. 3 to 5 show different types of receivers, FIG. 6 shows a table for the evaluation logic system of the receiver-terminal unit according to FIG. 2.

DETAILED DESCRIPTION OF INVENTION

Figure 1:
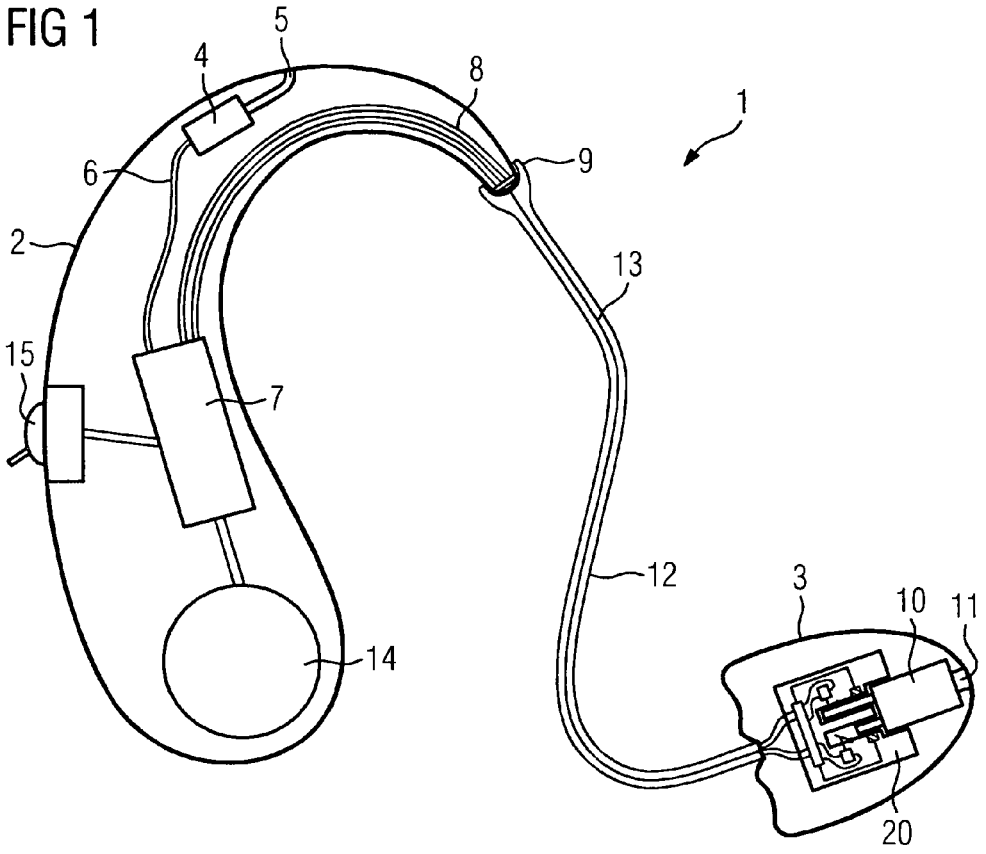
FIG. 1 shows a hearing aid device which may be worn behind the ear with an earpiece which may be worn in the ear.

FIG. 1 shows a hearing aid system according to the invention, which comprises merely one hearing aid device 1 having a device component 2 which may be worn behind the ear and an earpiece 3 which may be worn in the ear. The microphone 4 is present with the sound inlet 5 for receiving an acoustic input signal and converting said signal into an electrical input signal. This is connected by means of electrical cables 6 to a signal processing unit 7. In the signal processing unit 7, the electrical input signal emitted by the microphone 4 is processed and amplified depending on the signal frequency and conducted via electrical cables 8 and 13 as well as contacts 9 to a receiver 10, which converts the electrical output signal generated by the signal processing unit 7 into an acoustic output signal and emits said output signal via a sound channel 11 into the auditory canal of a user. In the hearing aid device 1 according to the exemplary embodiment, the receiver 10 is located in the earpiece 3. Accordingly, the hearing aid device 1 according to the exemplary embodiment is a so-called RIC-BTE. For connecting the device component 2, which may be worn behind the ear, to the earpiece 3 which may be worn in the ear, a connecting piece 12 is present in which the electrical cables 13 for connecting the signal processing unit 7 to the receiver 10 run. The connecting piece 12 is releasably connected to the device component 2. To this end, corresponding contacts 9 are present both on the device component 2 and on the connecting piece 12.

The hearing aid device 1 according to the exemplary embodiment further comprises a battery 14 for supplying power to the electronic components of the hearing aid device 1 as well as a switch 15, by means of which the hearing aid device may be switched on and off and different listening programs may be set for adapting the signal processing unit 7 to different acoustic environments.

The signal processing unit 7 of the hearing aid device 1 is able to be programmed. As a result, the signal processing in the signal processing unit 7 may be adapted to the individual hearing loss of a user. Moreover, an adaptation of the signal processing unit 7 to the electronic components used in the hearing aid device 1 and, in particular, the receiver 10 used, is possible. For the automatic identification of the type of receiver used in the hearing aid device 1, the hearing aid device 1 comprises a terminal unit 20 which is explained in more detail in FIG. 2.

Figure 2:
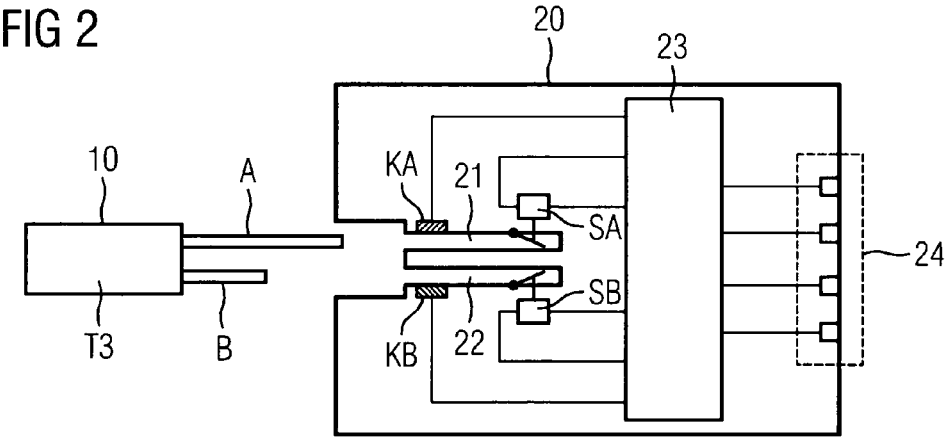
FIG. 2 shows a terminal unit for different types of receivers.

FIG. 2 shows in a schematic view the terminal unit 20 of the hearing aid device 1 which may be connected to different types of receiver, and which automatically identifies the respective type of receiver. The terminal unit 20 comprises socket connectors 21 and 22, into which connector pins A and B of a receiver 10 may be inserted. For differentiating between different types of receiver, the connector pins A and B may be differentiated by their length. In order to be able to differentiate between, for example, four different types of receiver, respectively having two connector pins, two different lengths of the connector pins A and B used are sufficient. In the exemplary embodiment according to FIG. 2, a receiver 10 with a long connector pin A and a short connector pin B are connected to the terminal device 20. In this case, by way of example, it is a receiver of the "T3" type. As is visible from the figure, after inserting the receiver 10 into the terminal unit 20 the connector pins A and B make contact with the contacts KA and/or KB. Moreover, the miniature switch SA is closed by the connector pin A whilst the miniature switch SB remains open. The evaluation logic system 23 converts the identified switch positions into logic levels, which are transmitted via an interface 24 and the cables 13 and 8 to the signal processing unit 7 of the hearing aid device 1. Parameters corresponding to the identified type of receiver are generated in the signal processing unit 7 using the transmitted logic levels and automatically adjusted in the signal processing unit 7.

In FIGS. 3 to 5, three further types of receiver are shown which may be differentiated by two connector pins A and B, which may respectively have two different lengths. In this case, FIG. 3 shows a receiver of the "T2" type with a short connector pin A and a long connector pin B, FIG. 4 shows a receiver of the "T1" type with a short connector pin A and a short connector pin B and FIG. 5 shows a receiver of the "T4" type with a long connector pin A and a long connector pin B.

FIG. 6 shows in tabular form, for further clarification of the automatic identification of the type of receiver, an association of the switch positions of the switches SA and SB to the respective type of receiver which is able to be automatically identified by the hearing aid device 1. The association according to the table shown corresponds to the association of the types of receiver according to FIGS. 2 to 5. With a short connector pin A and/or B the corresponding switch SA and/or SB remains open in the socket 21 and/or 22 (corresponding to the input "open" in the table according to FIG. 6), with a long connector pin A and/or B, the corresponding switch SA and/or SB is closed in the socket 21 and/or 22 (corresponding to the input "close" in the table according to FIG. 6). By the specific mechanical design of the connector pins A and B, in combination with the evaluation logic system 23 four different types of receiver are therefore reliably identified. As a result, the signal processing of the relevant hearing aid device is automatically adapted to the respective type of receiver used. Thus by means of the invention, incorrect settings relative to the receiver used are prevented.

As an alternative to the exemplary embodiment shown, the evaluation logic system may also be located in the device component 2 of the hearing aid device 1, preferably integrated in the signal processing unit 7.

Figure 7:
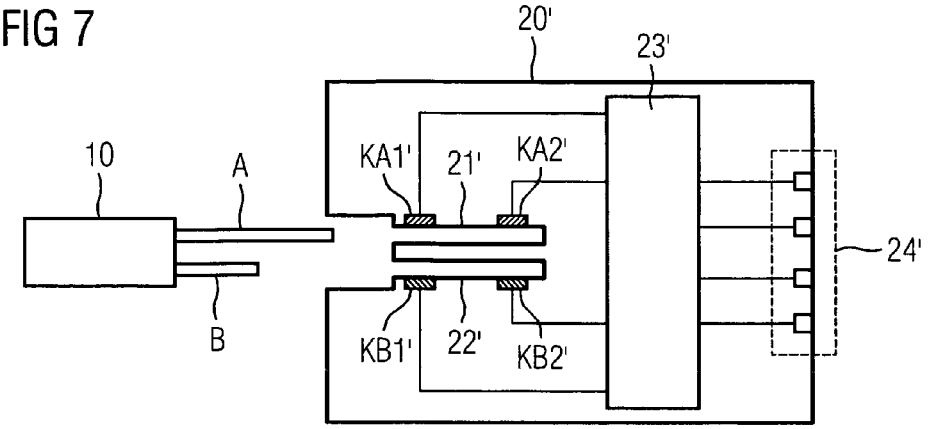
FIG. 7 shows a receiver-terminal unit with multi-stage contacts.

FIG. 7 shows an alternative embodiment of the terminal unit 20'. In contrast to the exemplary embodiment according to FIG. 2, in this case a multi-stage contact arrangement is used with contacts KA1', KA2' and/or KB1', KB2' connected in series in the socket connectors 21' and/or 22'. The detection of the lengths of the connector pins A and B of the receiver 10 used may in this case, for example, be detected by testing whether an electrical connection is present between the respective contacts KA1', KA2' and/or KB1', KB2'. The testing may, for example, be carried out after each time the relevant hearing aid device is switched on, before an electrical output signal is emitted to the receiver 10. In this embodiment, the evaluation preferably also takes place by means of an evaluation logic system 23', which is located in the exemplary embodiment directly in the terminal unit 20'.

The use of receiver-connector pins of different lengths is only one example of a plurality of possible mechanical features, by means of which the hearing aid system may differentiate between different types of receiver. Moreover, this feature does not have to be directly located on the receiver. Thus, for example, the coding relative to the type of receiver used may advantageously also be accommodated in the region of the contact arrangement 39, in particular when the earpiece 33 and the connecting piece 42 are embodied as a unit.

Figure 8:
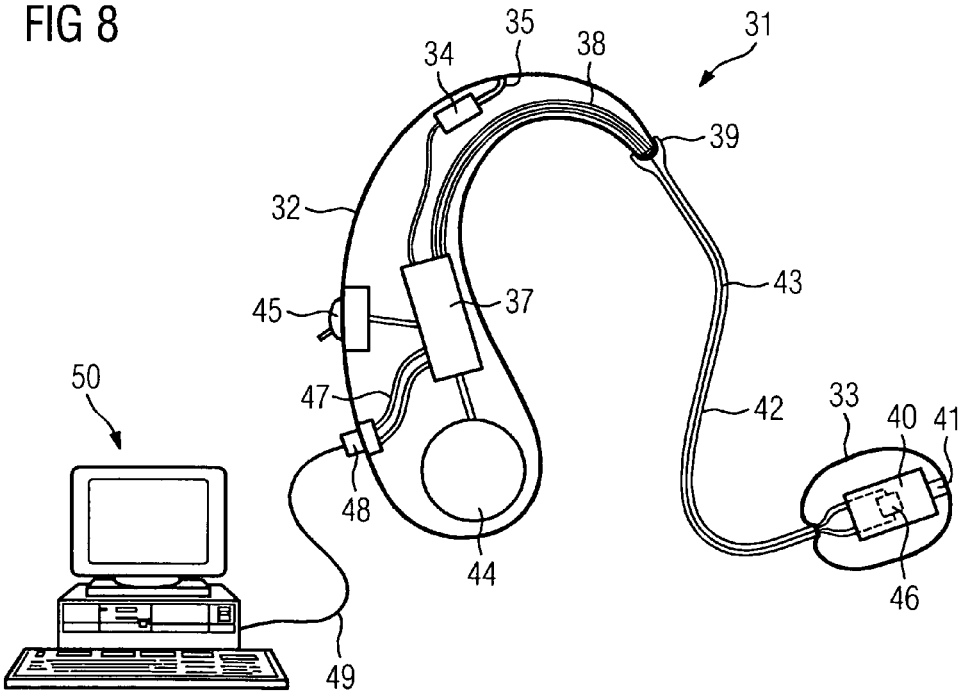
FIG. 8 shows a hearing aid system comprising a hearing aid device and a programming device.

FIG. 8 shows a further exemplary embodiment of the invention. In this case, the hearing aid system according to the invention comprises a hearing aid device 31 which, corresponding to the hearing aid device 1 according to FIG. 1, comprises a device component 32 which may be worn behind the ear, with a microphone 34, a sound inlet 35, a signal processing unit 37, a battery 44 and a switch 45. Moreover, the hearing aid device 31 comprises an earpiece 33 which may be releasably connected to the device component 32, which comprises a receiver 40 with a sound outlet 41. The electrical connection of the earpiece 33 to the device component 32 takes place via a connecting piece 42, in which electrical cables 43 run, which connects the receiver 40 via cables 38 and contacts 39 to the signal processing unit 37 of the hearing aid device 31.

To differentiate between different types of receiver, a resistor 46 is located in the receiver 40 which may be connected to a programming device 50 via the electrical cables 43, 38 and 47, the contacts 39, a programming terminal 48 and a programming cable 49. In the programming device 50, the value of the resistor 46 is automatically detected, from which the programming device 50 identifies the type of receiver used. Moreover, depending on the type of receiver identified, the programming device 50 automatically determines parameters for controlling the signal processing in the signal processing unit 37, which are transmitted by the programming device 50 to the hearing aid device 31. Thus in the hearing aid system according to FIG. 8, which in addition to the hearing aid device 31 comprises the programming device 50, the signal processing is automatically adapted to the type of receiver used.

In an alternative embodiment, the hearing aid device 31 comprises means for determining the value of the resistor 46, the detected value being stored in a memory of the signal processing unit 37. For automatically determining suitable parameters for controlling the signal processing depending on the type of receiver used, the stored value is transmitted via the programming terminal 48 and the programming cable 49 to the programming device 50.

The exemplary embodiments show only a small selection of possible mechanical or electrical features, which are automatically identified by the hearing aid device and/or a programming device connected thereto, by means of corresponding sensors and which may be used in corresponding values of parameters for adapting the signal processing in the hearing aid device to the receiver used. In particular, it is also not necessary that these features, as set forth in the exemplary embodiments (different lengths of the connector pins; connection to different resistors) are directly associated with the respective receiver. Thus it is also possible, for example, to consider the earpiece with the receiver located therein and the connecting piece as separate units, which provide the characteristic feature for the respective type of receiver at a different point, rather than in direct connection with the receiver. Thus, for example, a particular mechanical feature in the form of a specific number of detectable latching lugs may be located in the region of the contacts 9 and/or 39 or a detectable resistor may be located at a different point of the disclosed unit rather than in direct contact with the receiver.

The invention claimed is:

1. A hearing aid system, comprising:

a hearing aid device having:

an input transducer for receiving an input signal and converting said signal into an electrical input signal, a signal processing unit for processing and amplifying the electrical input signal and emitting an electrical output signal, and a receiver for converting the electrical output signal into an acoustic output signal, said receiver having a mechanical feature characteristic associated with a respective type of said receiver in the form of receiver-connector pins for electrical contact; and means including a microswitch for automatically identifying a type of receiver used in the heating aid device by differentiating between different lengths of said receiver connector pins.

2. The hearing aid system as claimed in claim 1, comprises means for automatic adaptation of the signal processing unit to the type of receiver identified.

3. The hearing aid system as claimed in claim 2, wherein the hearing aid device comprises a multi-stage contact arrangement for differentiating between different lengths of the receiver-connector pins.

4. The hearing aid system as claimed in claim 2, wherein the automatic adaptation of the signal processing unit is carried out by the hearing aid device.

5. The hearing aid system as claimed in claim 3, wherein the hearing aid device is embodied as a hearing aid device which may be worn behind the ear, comprising an earpiece projecting into the auditory canal in which the receiver is arranged.

6. The hearing aid system as claimed in claim 4, wherein the receiver is able to be releasably connected to the hearing aid device or the earpiece.

7. The hearing aid system as claimed in claim 2, wherein the signal processing unit is configured to adjust the amplifying based on the type of receiver.

* * * * *